US010835017B2

(12) United States Patent
Quennessen et al.

(10) Patent No.: US 10,835,017 B2
(45) Date of Patent: Nov. 17, 2020

(54) DEVICE FOR PERSONALIZING FRAGRANCE

(71) Applicant: Coty Inc., New York, NY (US)

(72) Inventors: Bernard Quennessen, New York, NY (US); Arnaud Bonafos, New York, NY (US); Eva Vinas Sanz, New York, NY (US)

(73) Assignee: Coty Inc., New York, NY (US)

( * ) Notice: Subject to any disclaimer, the term of this patent is extended or adjusted under 35 U.S.C. 154(b) by 57 days.

(21) Appl. No.: 15/662,183

(22) Filed: Jul. 27, 2017

(65) Prior Publication Data

US 2018/0027947 A1 Feb. 1, 2018

Related U.S. Application Data

(60) Provisional application No. 62/367,563, filed on Jul. 27, 2016.

(51) Int. Cl.
*A45D 40/24* (2006.01)
*A45D 33/22* (2006.01)
(Continued)

(52) U.S. Cl.
CPC ..... *A45D 40/24* (2013.01); *A45D 33/22* (2013.01); *A45D 40/00* (2013.01); *B65D 11/188* (2013.01);
(Continued)

(58) Field of Classification Search
CPC ..... A45D 40/24; A45D 40/00; A45D 33/22; A45D 2040/0025; A45D 2040/0031;
(Continued)

(56) References Cited

U.S. PATENT DOCUMENTS 5,884,637 A * 3/1999 Joulia ..... A45D 33/00 132/318
6,286,520 B1 * 9/2001 Lin ..... A45D 33/00 132/293

(Continued)

FOREIGN PATENT DOCUMENTS

CN 109475219 A 3/2019
JP 4895868 U 11/1973
JP 4898379 U 11/1973

OTHER PUBLICATIONS

"International Application Serial No. PCT/US2017/044250, International Preliminary Report on Patentability dated Feb. 7, 2019", 10 pgs.

(Continued)

*Primary Examiner* — Steven A. Reynolds
(74) *Attorney, Agent, or Firm* — Schwegman Lundberg & Woessner, P.A.

(57) ABSTRACT

Embodiments disclosed herein include a device for personalizing fragrance. The device includes a first module comprising a first hemispherical cap, a first container, and a first attacher; a first fragrance formulation contained by the first container; and a second module comprising a second hemispherical cap, a second container, and a second attacher. Also included is a second fragrance formulation, which can be different from the first fragrance formulation, and contained by the second container. The device includes a ring-shaped adaptor comprising a first feature for attaching to the first module at the first attacher and a second feature for attaching to the second module at the second attacher. When the first and second modules are each attached to the adaptor and the caps are in a closed position, the first module opposes the second module and the device has a capsule shape.

18 Claims, 5 Drawing Sheets

(51) Int. Cl.
*A45D 40/00* (2006.01)
*B65D 6/24* (2006.01)

(52) U.S. Cl.
CPC ..... *A45D 2040/0012* (2013.01); *A45D 2040/0025* (2013.01); *A45D 2040/0031* (2013.01)

(58) Field of Classification Search
CPC ..... A45C 11/008; A45C 5/005; B65D 11/188; B65D 11/105
USPC ..... 220/4.25, 4.24; 206/581
See application file for complete search history.

(56) References Cited

U.S. PATENT DOCUMENTS

| | | | | |
|---|---|---|---|---|
| 6,688,795 | B1 * | 2/2004 | Jacob | A45D 34/04 401/202 |
| 7,699,062 | B2 * | 4/2010 | Sasaki | A45D 40/10 132/298 |
| 8,651,308 | B1 * | 2/2014 | Sung | A45D 40/00 206/457 |
| 9,585,458 | B2 * | 3/2017 | Teller | A45D 40/00 |
| 9,924,776 | B2 * | 3/2018 | Schlatter | A45D 33/02 |
| 9,974,377 | B2 | 5/2018 | Keller et al. | |
| 10,039,366 | B1 * | 8/2018 | Facer | A45D 40/24 |
| 2002/0109262 | A1 * | 8/2002 | Grosz | A45D 40/16 264/255 |
| 2002/0127046 | A1 * | 9/2002 | Gueret | A45D 40/02 401/266 |
| 2016/0262522 | A1 * | 9/2016 | Teller | A45D 40/00 |

OTHER PUBLICATIONS

"International Application Serial No. PCT/US2017/044250, International Search Report dated Dec. 15, 2017", 6 pgs.
"International Application Serial No. PCT/US2017/044250, Invitation to Pay Add'l Fees and Partial Search Rpt dated Oct. 19, 2017", 10 pgs.
"International Application Serial No. PCT/US2017/044250, Written Opinion dated Dec. 15, 2017", 8 pgs.
"European Application Serial No. 17749572.8, Response dated Jul. 29, 2019 to Communication pursuant to Rules 161(1) and 162 EPC Apr. 3, 2019", 18 pgs.
"European Application Serial No. 17749572.8, Communication Pursuant to Rules 161(1) and 162 dated Feb. 8, 2019", 3 pgs.

* cited by examiner

DEVICE FOR PERSONALIZING FRAGRANCE

PRIORITY

This application claims the benefit of priority of U.S. Provisional Patent Application Ser. No. 62/367,563, filed on Jul. 27, 2016, and which is herein incorporated by reference in its entirety.

FIELD

Inventive subject matter disclosed herein refers to a device for personalizing fragrance delivery.

BACKGROUND

Fragrances are conventionally sold as single bottles of one fragrance. Users desiring to use multiple fragrances on different body areas have an option to buy multiple bottles of fragrance. Typically, the fragrances are stored in glass and are not readily transported without risk of breakage.

SUMMARY

Embodiments disclosed herein include a device, comprising a first module that includes a first container that includes a cap portion having a hemispherical shape and a first attacher. A first fragrance is disposed within the first container when the cap is in a closed position. The device also includes a second module that includes a second container having a cap portion having a hemispherical shape and a second attacher. A second fragrance is disposed within the second container when the cap is in a closed position. The device also includes a ring-shaped adaptor that includes an attacher for attaching to the first module at the first attacher and another attacher for attaching to the second module at the second attacher so that the first module opposes the second module when attached. The device has a capsule shape when the first module and second module are attached to the adaptor and the cap portions are in a closed position. In an example, the first and second fragrances can be solid at room temperature. In an example, the first and second fragrances can be anhydrous fragrances.

Another embodiment includes a device that includes a first platform, a second platform opposing the first platform, and a hinge attached to the first platform and the second platform. The device also includes a first fragrance module threadably attached to the first platform; and a second fragrance module threadably attached to the second platform.

Another embodiment includes a device that includes an adaptor having an exterior annular surface and an opposing internal annular surface, the internal annular surface defining threads. The device also includes a container and a solid fragrance formulation contained in the container, wherein the solid fragrance has an upper surface in a dome shape, the container having an outer surface defining threads that render the container attachable to the adaptor; a dome cap sized to receive the dome of the solid fragrance. The device also includes a modular cap that encloses the dome cap and solid fragrance, the modular cap having threads threadably attachable to the container. The device also includes a second container and a second solid fragrance contained by the second container, wherein the fragrance has a dome shape, the second container has threads that render the container attachable to the adaptor. The device also includes a second dome cap sized to receive the second dome of the solid fragrance formulation, the dome cap defining a lip, the dome cap resting on an upper surface of the second container. The device also includes a second modular cap that encloses the second dome cap and solid fragrance, the second modular cap being threadably attachable to the second container. In an example, the fragrances are anhydrous fragrances.

DETAILED DESCRIPTION

The following detailed description includes embodiments, which are also referred to herein as "examples," and which are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

Figures 1, 2, 3:
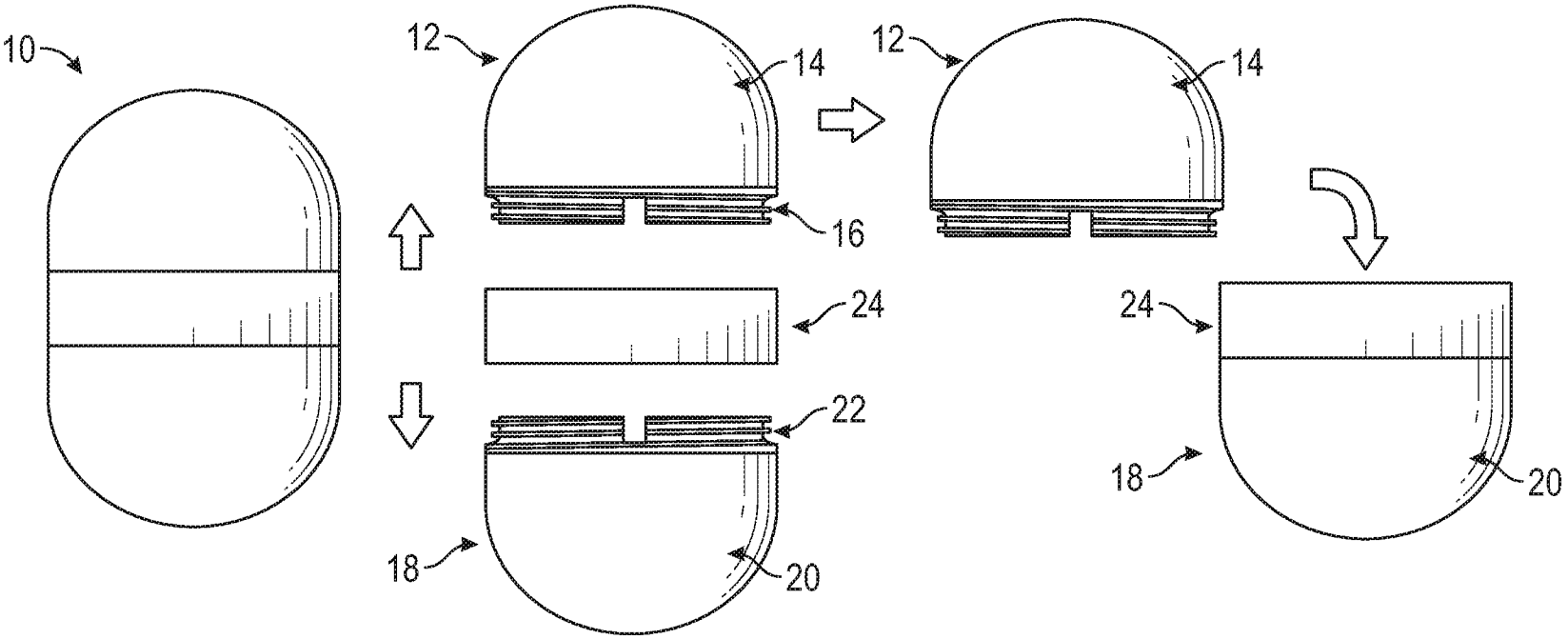
FIG. 1 illustrates a side view of one embodiment of the device for personalizing fragrance of the present invention.
FIG. 2 illustrates an exploded view of the device of FIG. 1.
FIG. 3 illustrates a side view of the device of FIG. 1, showing a separation of a module of the device for personalizing fragrance.

Embodiments disclosed herein include a device, one embodiment of which is illustrated at 10 in FIG. 1 in a closed position. The device 10 includes a main body in the shape of a capsule enclosing two fragrances. In an example, the fragrance is in an anhydrous substrate and can be described herein as an anhydrous fragrance. In an example, the fragrance can be solid or non-flowable at room temperature. The device 10 includes a first module 12 that includes a first container 14 with a cap having a hemispherical shape and a first attacher 16, shown in FIG. 2. A first anhydrous fragrance is disposed within the container and enclosed by the cap when the cap is in a closed position, as shown in FIG.

1. The device 10 also includes a second module 18 that includes a second container 20 with a cap having a hemispherical shape and a second attacher 22. A second anhydrous fragrance is disposed within the second container 20 and is enclosed by the second cap when the cap is in a closed position, as shown in FIG. 1.

The prefix 'hemi', as used in terms such as 'hemisphere' and 'hemispherical,' is understood to denote a portion. As such, an element described as hemispherical can include half of a sphere, more than half of a sphere, or less than half of a sphere.

The device 10 also includes a ring-shaped adaptor 24 that includes one or more features for attaching to the first module 12 at the first attacher 16 and for attaching to the second module 18 at the second attacher 22 so that the first module 12 opposes the second module 18 when attached. Examples of such features are described below in reference to other figures; however, it is recognized that a variety of known engagement or attachment features can be used to permanently, semi-permanently or removably attach the adaptor 24 to each of the first module 12 and second module 18. The device 10 has a capsule shape, shown in FIG. 1, when the first module 12 and second module 18 are attached to the adaptor 24, in a closed position, as shown in FIG. 2.

As used herein, the terms 'permanently' and 'semi-permanently' can refer to an attachment or engagement of two parts that requires one or more tools to detach or disengage the parts from one another. In an example, semi-permanent can refer to an attachment or engagement of two parts that can be reversed using a tool and the parts are not damaged and can be reattached to one another. In an example, permanent can refer to an attachment or engagement of two parts that cannot be reversed without damaging one or both of the parts. As used herein, 'removably attached' can refer to an attachment or engagement of two parts that can be easily detached from one another by the user of the device and such detachment may be by hand manipulation, without damage to the parts, and without any tooling.

In an example and as shown in FIG. 2, the first module 12 includes threaded portion 16 and the second module 18 includes threaded portion 22. The adaptor 24 includes threads on an inner annular surface of the adaptor 24, the threads having a size and shape that receive threads from the threaded portion or first attacher 16 and the threaded portion or second attacher 22. FIG. 3 shows that the first module 12 is threadably releasable from the adaptor 24. Another module which is not shown having a different fragrance or a recharged fragrance is threadably attachable to the adaptor when the module 12 is released and replaced with the other module. The second module 18 can similarly be detached and replaced. The device 10 thus provides a variety of fragrance options and combinations to the user. In another example, the first module 12 and second module 18 can be preselected, either by the user or manufacturer, and the device 10 is designed such that one or both of the first module 12 and second module 18 are not detachable from the device 10 once assembled.

Embodiments disclosed herein enable users to interchange the two fragrances or mix them or customize them. The modules have fragrance combinations that include, but are not limited to natural and sweet, and other combinations not heretofore made.

Figure 4:
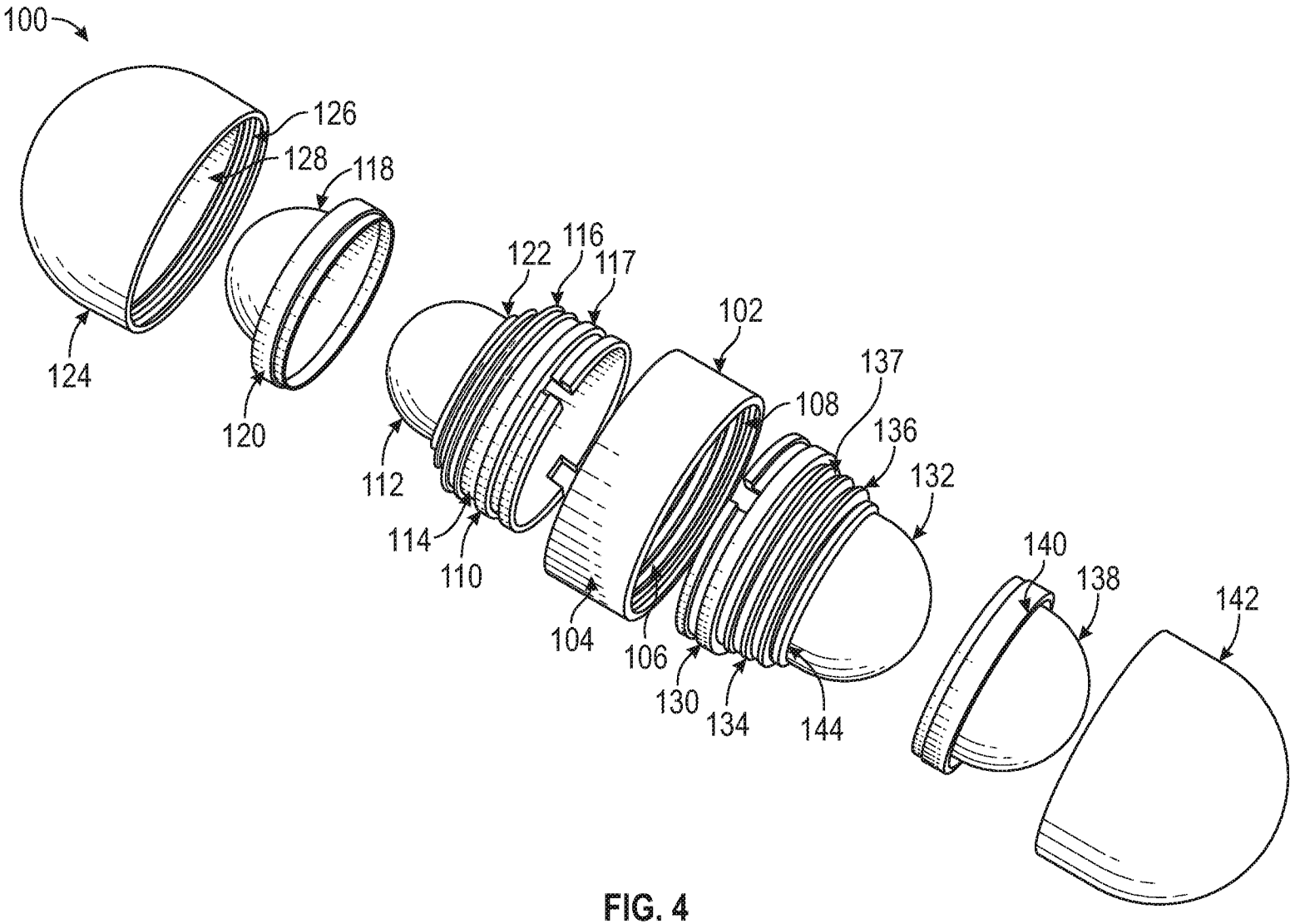
FIG. 4 illustrates an exploded perspective view of another embodiment of the device for personalizing fragrance.

FIG. 4 illustrates an exploded view of another embodiment of the device 100 for personalizing fragrance. The device 100 includes an adaptor 102 having an exterior annular surface 104, facing outwardly, and an internal annular surface 106. The internal annular surface 106 defines threads 108 effective for receiving threads of a container 110 and 130 of a fragrance module.

The device 100 also includes a container 110 and a solid fragrance 112, contained by the container 110. In an example, the solid fragrance 112 can be an anhydrous fragrance. In the embodiment shown, the solid fragrance 112 has an upper surface that has a dome shape. The container 110 has an outer surface 114 defining upper threads 116 and lower threads 117. The lower threads 117 render the container 110 attachable to the threads 108 defined by the annular inner surface 106 of the adaptor. The term 'solid' as used herein in reference to the fragrances can mean that the fragrances are solid or non-flowable at room temperature.

The device 100 also includes a dome cap 118 sized to enclose the dome 112 of the solid fragrance. The dome cap 118 also defines a lip 120 at a base of the dome. The dome cap 118 rests on an upper surface 122 of the container. The dome cap 118 protects the integrity of the dome 112 of the solid fragrance. A module cap 124 covers and encloses the dome cap 118, and solid fragrance 112. The module cap 124 includes threads 126 on an interior surface 128. The module cap 124 is attached to the container 110 with a threadable attachment of module cap threads 126 and threads upper 116 on the outer surface of the container 110.

The device 100 also includes a container 130 and a solid fragrance 132, contained by the container 130. In an example, the solid fragrance 132 can be an anhydrous fragrance. In the embodiment shown, the solid fragrance 132 has an upper surface that has a dome shape. The container 130 has an outer surface 134 defining upper threads 136 and lower threads 137. The lower threads 137 render the container 130 attachable to the threads 108 defined by the annular inner surface 106 of the adaptor. The container 130 opposes the container 110.

The device 100 also includes a dome cap 138 sized to enclose the dome 132 of the solid fragrance. The dome cap 138 also defines a lip 140 at a base of the dome. The dome cap 138 rests on an upper surface 144 of the container 130. The dome cap 138 protects the integrity of the dome 132 of the solid fragrance. A module cap 142 covers and encloses the dome cap 138, and solid fragrance 132. The module cap 142 includes threads which are not shown on an interior surface, also not shown. The module cap 142 is attached to the container 130 with a threadable attachment of module cap threads on an interior of the cap 142 (similar to threads 126 inside module cap 124) and upper threads 136 on the outer surface of the container 130.

Figure 5:
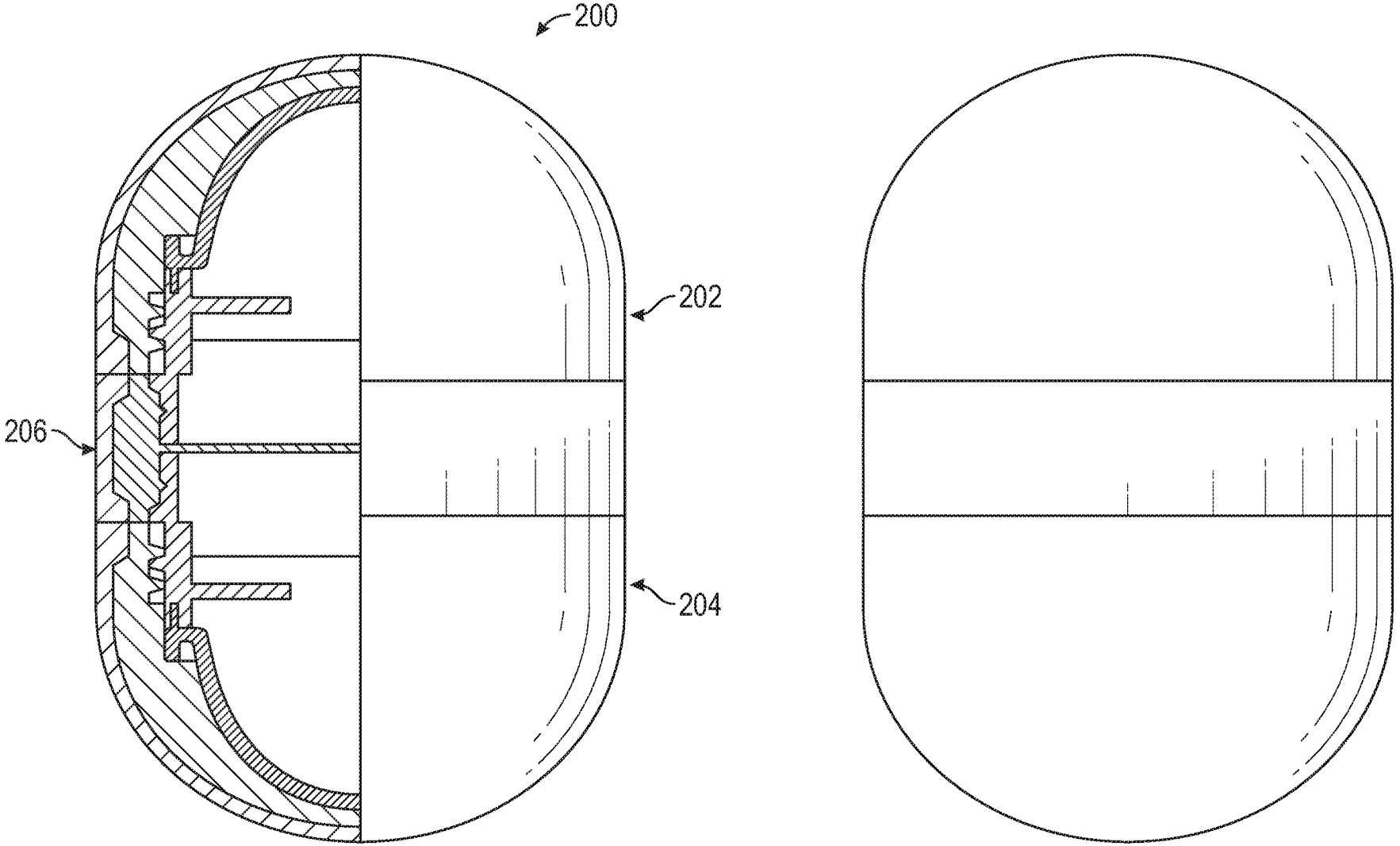
FIG. 5 illustrates a side view of another embodiment of the device for personalizing fragrance of the present invention.

Another embodiment, shown at 200 in FIG. 5, shows a capsule with a first module 202 and a second opposing module 204. The two modules are opened and closed with movement of a hinge 206. By "open" is meant that the module 202 or 204 is hingedly moved from its position forming a capsule 200.

Figure 6:
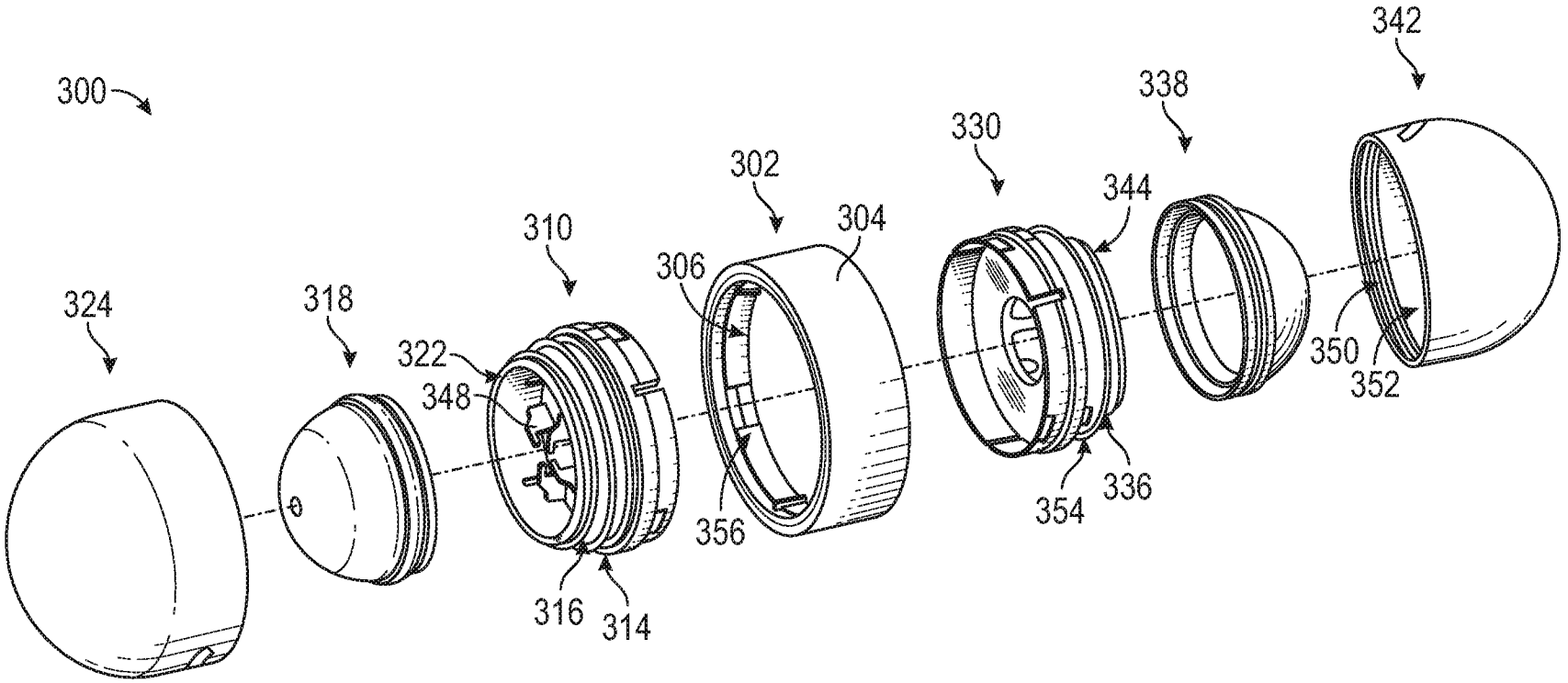
FIG. 6 illustrates an exploded perspective view of another embodiment of the device for personalizing fragrance.
Figure 7:
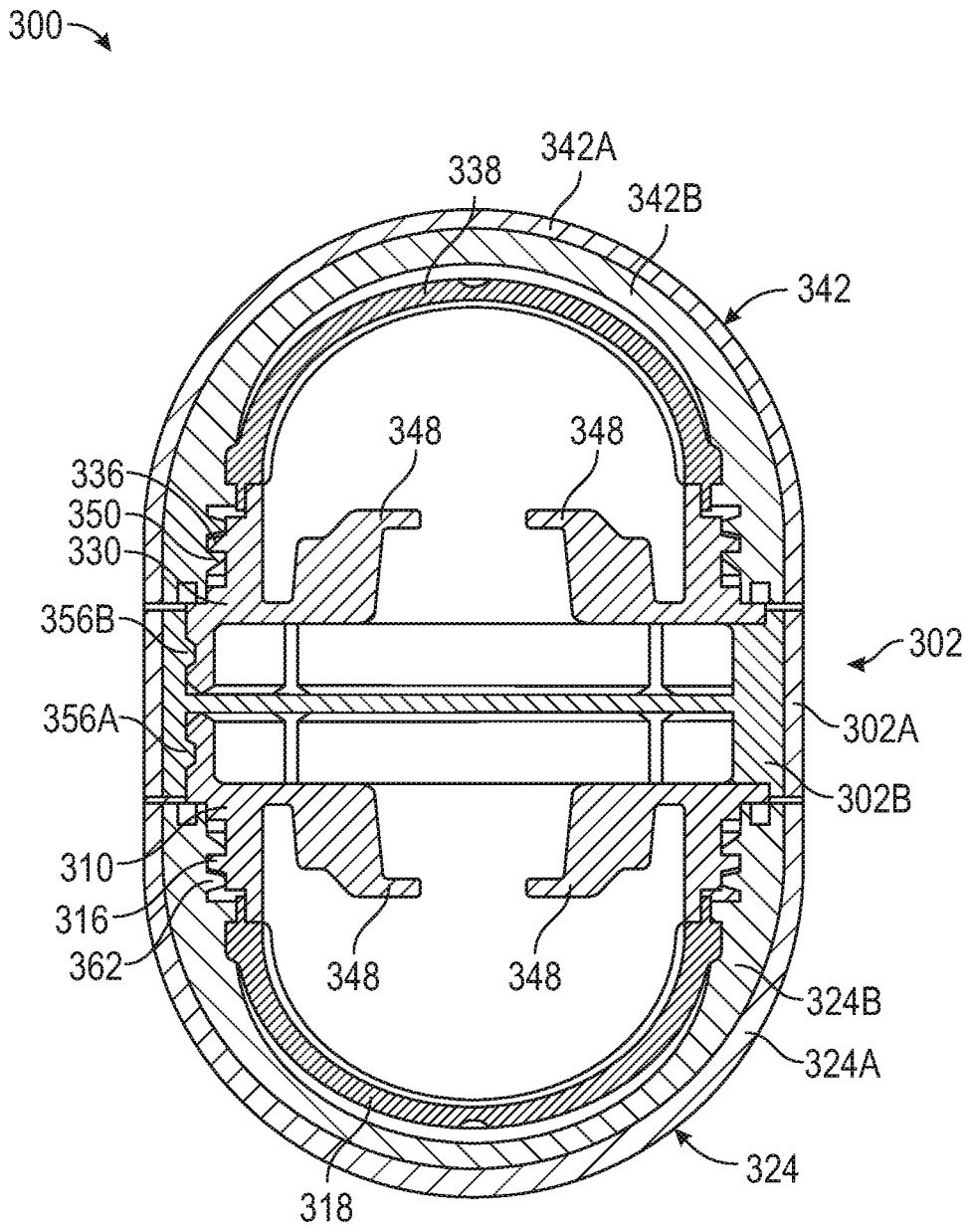
FIG. 7 illustrates a cross-sectional view of a length of the device of FIG. 6.

FIG. 6 illustrates an exploded view of another embodiment of the device 300 for personalizing fragrance. The device 300 generally includes the same components as the device 100 shown in FIG. 4; however, the fragrances for the device 300 are not included in FIG. 6. It is recognized that the device 300 can include fragrances that are similar to fragrances 112 and 132 of FIG. 4. FIG. 7 illustrates a cross-sectional view along a length of the device 300, when the device 300 is in a closed or assembled position.

The device 300 includes an adaptor or annular ring 302 having an exterior annular surface 304 (facing outwardly) and an internal annular surface 306. The adaptor 302 includes one or more features 356 on the interior surface 306 for receiving a first container 310 and for receiving a second container 330. First container 310 and second container 330 can have a solid fragrance attached thereto.

The one or more features 356 (shown in FIG. 6) can include one or more first engagement features 356A (an example of which is shown in FIG. 7) which engage with one or more corresponding features on the first container 310, and one or more second engagement features 356B (an example of which is shown in FIG. 7) which engage with one or more corresponding features on the second container 330. In an example, the engagement features 356 on the interior surface 306 of the ring 302 can include a raised portion 356A (FIG. 7) that engages with a corresponding feature on the first container 310. The corresponding feature can include a cavity, as shown in FIG. 7. The second container 330 can include a similar feature to container 310 for engagement with the ring 302. In one example, as shown in FIG. 6, a skirt portion of first container 310 and a skirt portion of second container 330 includes relief notches to provide alignment or to enable elastic deflection for mating with corresponding structure on the adapter 302.

The device 300 also includes a first dome cap 318 sized to enclose the dome-shaped first fragrance and a second dome cap 338 sized to enclose the dome-shaped second fragrance. The first dome cap 318 can rest on an upper surface 322 of the first container 310 and the second dome cap 338 can rest on an upper surface 344 of the second container 330. Each of the dome caps 318 and 338 can be covered and enclosed by a first modular cap 324 and a second modular cap 342, respectively. The first dome cap 318 and modular cap 324 can include corresponding features that facilitate either a permanent or releasable attachment of the dome cap 318 inside the modular cap 324. Similarly, the second dome cap 338 and modular cap 342 can include one or more corresponding features for attachment of the dome cap 338 inside the second modular cap 342.

The first modular cap 324 includes threads 362 (see FIG. 7) formed on an interior of the first modular cap 324. The first container 310 includes threads 316 formed on an outer surface 314 of the first container 310. The first modular cap 324 is removably attached to the first container 310 through threaded engagement. Similarly, the second modular cap 342 includes threads 350 formed on an interior surface 352 of the second modular cap 342. The second container 330 includes threads 336 formed on an outer surface 354 of the second container 330. The second modular cap 342 is removably attached to the second container 330 through threaded engagement of the threads 336 and 350.

The first container 310 can include one or more features to engage the first fragrance and secure the fragrance in position on the first container 310. In an example, the first container 310 includes one or more retainer features 346 that engage with the first fragrance to hold the fragrance in position. Similarly, the second container 330 includes one or more retainer features 348 that engage with the second fragrance to hold the fragrance in position. The cross sectional view in FIG. 7 shows two retainers 348 in each of the first container 310 and second container 330. The perspective view of the container 310 in FIG. 6 shows four retainers 348. It is recognized that more than or less than four retainers 348 can be included in the first container 310 or second container 330. In an example, the retainers 348 can define a star formation. It is recognized that any number of retainers 348 can be included in the design of the first container 310 or second container 330 in order to secure the fragrance in place on the container 310 or 330. Moreover, other features with varying structure can be used on the containers 310 and 330, in addition to or as an alternative to the specific retainers 346, 348 as shown in FIG. 7, for engagement with the first and second fragrances.

As shown in FIG. 7, in an example, the modular caps 324, 342 and adaptor 302 can each be formed of two layers or "over-molded". The first modular cap 324 includes outer layer 324A and inner layer 324B. The second modular cap 342 includes outer layer 342A and inner layer 342B. For each of the caps 324 and 342, the outer layer forms the exterior of the caps 324 and 342 and is the contact surface for the user. The inner layer includes the threads and other features for engagement with the respective dome cap and container. The adaptor 302 includes outer layer 302A and inner layer 302B. In an example, the inner layers 324B, 342B or 302B can be formed of a material sufficient for mechanical structure, such as, for example, polypropylene or another type of polymer, and the outer/exterior layers 324A, 342A or 302A can be formed of a lower strength material for appearance or user comfort. In some designs it may be preferable for the exterior surface to be "soft-touch", in which case the two layer or over-molded design can be used. In other designs, a single layer can be used for the caps 324, 342 and adaptor 302.

To assemble the device 300, the first dome cap 318 is attached to the first modular cap 324, such as through a press-fit or interference fit, in one example, and the first modular cap 324 is attached to the first container 310, such as through a threaded connection, in one example. A sub-assembly of the caps 318, 324 and container 310 is attached to the adaptor 302, using the corresponding features described above. The features can include, but are not limited to, a press-fit, interference fit, or male and female threaded portions. The features can include at least one elastic component which deflects or compresses to engage with the corresponding component. A second sub-assembly of the second caps 338, 342 and second container 330 is similarly formed and then attached to the adaptor 302.

The user of the device 300 can access and use the first or second fragrance by removing the first modular cap 324 (and the dome cap 318 contained therein) or second modular cap 342 (and the dome cap 338 contained therein) from the device 300. An exterior of the caps 324 and 342 can be sized and shaped such that a user can easily remove cap 324 or 342 from the device without the use of tools. For the design of the device 300 in which the caps 324 and 342 include internal threads that correspond to threads on each of the containers 310 and 330, respectively, each of the caps 324 and 342 is removed by twisting the cap 324 or 342 to disengage the threaded connection between the caps 324, 342 and the container 310, 330.

The attachment or engagement features for the components of the devices disclosed herein, including devices 10, 100, 200 and 300, are some of the configurations for either releasable attachment, permanent attachment or semi-permanent attachment. It is recognized that additional attachment or engagement features can be used in addition to or as an alternative to those specifically described and shown herein. The particular attachment or engagement feature selected for each combination of components can depend on whether such combination of components is intended to be easily detachable from one another, with or without the use of a tool. For example, if the fragrances are rechargeable or replaceable in the design of the device 300, the first container 310 and the adaptor 302 can be releasably engaged with one another and the user of the device 300 can remove the first container 310 from the device 300. If the fragrances are not replaceable and the device 300 is discarded after depletion of the first and second fragrances, the first container 310 and the adaptor 302 can be permanently or semi-permanently engaged with one another. As described above, the devices disclosed herein are designed such that the caps 324 and 342 are easily removably from engagement with the respective container 310, 330, in order to easily or repeatedly access the first or second fragrance.

In an example in which the fragrances are anhydrous, the fragrances contained within the devices disclosed herein, including devices 10, 100, 200 and 300, include an anhydrous substrate in which encapsulated fragrance formulations are suspended. For some embodiments, users apply each fragrance by exposing the fragrance to skin. The fragrance can be applied directly to a skin surface. For some embodiments, fragrance release can occur over an 8 to 12 hour period. For some embodiments, the devices 10, 100, 200 and 300 are wearable by the user; for example, the device can be received on or be part of a necklace such that the device can be worn as a pendant. The devices 10, 100, 200 and 300 enable users to select their own combinations of fragrance to create desired blends for themselves. The embodiments 10, 100, 200 and 300 are small and transportable. For some embodiments, the device can be carried in a user's pocket, bag or suitcase and there is not leakage or risk of glass breakage.

The embodiments are described in sufficient detail to enable those skilled in the art to practice the invention. Other embodiments may be utilized and formulation and method of using changes may be made without departing from the scope of the invention. The detailed description is not to be taken in a limiting sense, and the scope of the invention is defined only by the appended claims, along with the full scope of equivalents to which such claims are entitled.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the present description.

The present application provides for the following exemplary embodiments or examples, the numbering of which is not to be construed as designating levels of importance:

Example 1 provides a device comprising a first module comprising a first hemispherical cap, a first container, and a first attacher; a first fragrance formulation contained by the first container, when the first cap is in a closed position; a second module comprising a second container having a second hemispherical cap and a second attacher; and a second fragrance formulation contained by the second container, when the second cap is in a closed position. The device further comprises a ring-shaped adaptor comprising a first feature for attaching to the first module at the first attacher and a second feature for attaching to the second module at the second attacher, wherein when the first and second modules are each attached to the adaptor and the caps are in a closed position, the device has a capsule shape and the first module opposes the second module.

Example 2 provides the device of Example 1 optionally configured such that the first and second attachers are screw threads.

Example 3 provides the device of any one or more of Examples 1 or 2 optionally configured such that the first and second features of the ring-shaped adaptor are screw threads.

Example 4 provides the device of any one or more of Examples 1-3 optionally configured such that the first fragrance formulation is different from the second fragrance formulation.

Example 5 provides the device of any one or more of Examples 1-4 optionally configured such that the first and second fragrance formulations are solids at room temperature.

Example 6 provides the device of any one or more of Examples 1-5 optionally configured such that the first and second fragrance formulations are dome shaped.

Example 7 provides the device of any one or more of Examples 1-6 optionally configured such that the first and second fragrance formulations are applied to skin of a user of the device.

Example 8 provides the device of any one or more of Examples 1-7 optionally configured such that the first and second modules are interchangeable with other modules having different fragrances.

Example 9 provides the device of any one or more of Examples 1-8 optionally configured such that the first and second modules are removably attached to the ring-shaped adaptor once the device is assembled.

Example 10 provides the device of any one or more of Examples 1-7 optionally configured such that a portion of the first and second modules are permanently or semi-permanently attached to the ring-shaped adaptor once the device is assembled.

Example 11 provides the device of any one or more of Examples 1-10 optionally configured such that the first and second caps are removable from the first and second modules to expose the first and second fragrance formulations to a user of the device.

Example 12 provides the device of any one or more of Examples 1-10 optionally configured such that the first hemispherical cap is part of the first container and the second hemispherical cap is part of the second container, and the first and second fragrances are contained within an interior of the first and second containers, respectively.

Example 13 provides the device of any one or more of Examples 1-12 optionally configured such that each of the first and second fragrance formulations is an anhydrous fragrance formulation.

Example 14 provides the device of any one or more of Examples 1-11 and 13 optionally configured such that a bottom portion of the first fragrance is coupled to a top portion of the first container and when the first hemispherical cap is in a closed position, at least a top portion of the first anydrous fragrance is received by the first hemispherical cap, and wherein a bottom portion of the second fragrance is coupled to a top portion of the second container and when the second hemispherical cap is in a closed position, at least a top portion of the second anydrous fragrance is received by the second hemispherical cap.

Example 15 provides the device of any one or more of Examples 1-11 and 13-14 optionally configured such that the first module further comprises a first modular cap that receives the first hemispherical cap, and the second module further comprises a second modular cap that receives the second hemispherical cap.

Example 16 provides the device of any one or more of Examples 1-11 and 13-15 optionally configured such that the first attacher is part of the first container and the first modular cap removably attaches to the first attacher, and the first modular cap is removed from the first module to expose the first fragrance formulation to a user of the device.

Example 17 provides the device of any one or more of Examples 15 or 16 optionally configured such that the second attacher is part of the second container and the second modular cap removably attaches to the second attacher, and the second modular cap is removed from the second module to expose the second fragrance formulation to a user of the device.

Example 18 provides the device of any one or more of Examples 15-17 optionally configured such that the first and second modular caps each include an inner layer formed of a first material and an outer layer formed of a second material different from the first material.

Example 19 provides the device of Example 18 optionally configured such that the first material is stronger than the second material.

Example 20 provides the device of any one or more of Examples 1-19 optionally configured such that the ring-shaped adaptor includes an inner layer formed of a first material and an outer layer formed of a second material different from the first material.

Example 21 provides the device of Example 20 optionally configured such that the first material is stronger than the second material.

Example 22 provides the device of any one or more of Examples 1-21 optionally configured such that the first and second containers each comprise one or more features extending from a top portion of the respective container, the one or more features engaging with the first and second fragrance formulations.

Example 23 provides the device of Example 22 optionally configured such that the one or more features comprise one or more retainers that are least partially contained within a bottom portion of each of the first and second fragrance formulations.

Example 24 provides a device comprising an adaptor having an exterior annular surface and an opposing internal annular surface, the internal annular surface defining one or more first engagement features and one or more second engagement features; a first container and a first solid fragrance contained by the first container, wherein the first solid fragrance has a dome-shaped upper surface, the first container having an outer surface defining one or more first corresponding features for engagement with the one or more first engagement features of the adaptor to attach the first container to the adaptor; a first dome cap sized to at least partially receive the first solid fragrance; and a first modular cap that encloses the first dome cap and first solid fragrance, the first modular cap removably attachable to the first container. The device further comprising a second container and a second solid fragrance contained by the second container, wherein the second solid fragrance has a dome-shaped upper surface, the second container having an outer surface defining one or more second corresponding features for engagement with the one or more second engagement features of the adaptor to attach the second container to the adaptor; a second dome cap sized to at least partially receive the second solid fragrance; and a second modular cap that encloses the second dome cap and second solid fragrance, the second modular cap removably attachable to the second container.

Example 25 provides the device of Example 24 optionally configured such that the first solid fragrance is different from the second solid fragrance.

Example 26 provides the device of any one or more of Examples 24 or 25 optionally configured such that the first and second containers are removably attached to the adaptor.

Example 27 provides the device of any one or more of Examples 24-26 optionally configured such that the first and second containers are interchangeable with other containers having different solid fragrances.

Example 28 provides the device of any one or more of Examples 24 or 25 optionally configured such that the first and second containers are permanently or semi-permanently attached to the adaptor after assembly of the device.

Example 29 provides the device of any one or more of Examples 24-28 optionally configured such that the first modular cap includes threads on an interior surface for threaded engagement with threads on an exterior surface of the first container, and the second modular cap includes threads on an interior surface for threaded engagement with threads on an exterior surface of the second container.

Example 30 provides the device of any one or more of Examples 24-29 optionally configured such that the first dome cap rests on an upper surface of the first container and the second dome cap rests on an upper surface of the second container.

Example 31 provides the device of any one or more of Examples 24-30 optionally configured such that the first dome cap and the first modular cap include corresponding features for securing the first dome cap inside the first modular cap, and the second dome cap and the second modular cap include corresponding features for securing the second dome cap inside the second modular cap.

Example 32 provides the device of any one or more of Examples 24-31 optionally configured such that the first and second containers each include one or more features extending from a top portion of the respective container for engagement with the first and second solid fragrances.

Example 33 provides the device of Example 32 optionally configured such that the one or more features include retainers that at least partially extend into an interior of the first and second solid fragrances.

Example 34 provides the device of any one or more of Examples 24-33 optionally configured such that the first and second modular caps each include an inner layer formed of a first material and an outer layer formed of a second material different from the first material.

Example 35 provides the device of any one or more of Examples 24-34 optionally configured such that the adaptor includes an inner layer formed of a first material and an outer layer formed of a second material different from the first material.

Example 36 provides the device of any one or more of Examples 24-35 optionally configured such that each of the first and second solid fragrances comprises an anhydrous substrate and encapsulates a fragrance suspended within the anhydrous substrate.

Example 37 provides the device of any one or more of Examples 24-36 optionally configured such that the first and second solid fragrances are applied to skin of a user of the device.

Example 38 provides a device comprising a first platform; a second platform opposing the first platform; and a hinge mechanism attached to the first platform and the second platform; a first fragrance module threadably attached to the first platform, the first fragrance module comprising a first container and a first fragrance at least partially contained by the first container; and a second fragrance module threadably attached to the second platform, the second fragrance module comprising a second container and a second fragrance at least partially contained by the second container, wherein each of the first and second fragrance modules can be moved from an open position to a closed position at the hinge mechanism.

Example 39 provides the device of Example 38 optionally configured such that the first and second fragrances are solids at room temperature.

Example 40 provides the device of any one or more of Examples 38 or 39 optionally configured such that the first fragrance is different from the second fragrance.

Example 41 provides the device of any one or more of Examples 38-40 optionally configured such that the first and second fragrances are anhydrous.

Example 42 provides the device of any one or more of Examples 38-40 optionally configured such that the first and second fragrance modules are removable from the first and second platforms, respectively, and are interchangeable with different fragrance modules.

Example 43 provides the device of any one or any combination of Examples 1-42, which can be optionally configured such that all elements recited are available to use or select from.

What is claimed is:

1. A device, comprising:

a first module comprising a first container having a first hemispherical cap and a first attacher, the first module further comprising a first modular cap that receives the first hemispherical cap;

a first fragrance formulation contained by the first container, when the first modular cap is in a closed position;

a second module comprising a second container having a second hemispherical cap and a second attacher, the second module further comprising a second modular cap that receives the second hemispherical cap;

a second fragrance formulation contained by the second container, when the second modular cap is in a closed position; and a ring-shaped adaptor separate from the first module and separate from the second module, the adaptor comprising a first feature for removably attaching to the first module at the first attacher and a second feature for removably attaching to the second module at the second attacher, wherein when the first and second modules are each attached to the adaptor and the first and second modular caps are in a closed position, the device has a capsule shape and the first module opposes the second module, and wherein the first modular cap includes threads that engage with corresponding threads on the first container for removable attachment of the first modular cap to the first container and the second modular cap includes threads that engage with corresponding threads on the second container for removable attachment of the second modular cap to the second container.

2. The device of claim 1, wherein the first and second attachers are screw threads, and the first and second features of the ring-shaped adaptor are screw threads.

3. The device of claim 1, wherein the first fragrance formulation is different from the second fragrance formulation.

4. The device of claim 1, wherein the first and second fragrance formulations are solids at room temperature.

5. The device of claim 1, wherein the first and second modular caps are removed from the first and second containers to expose the first and second fragrance formulations to a user of the device.

6. The device of claim 1, wherein the first hemispherical cap is part of the first container and the second hemispherical cap is part of the second container, and the first and second fragrance formulations are contained within an interior of the first and second containers, respectively.

7. The device of claim 1, wherein each of the first and second fragrance formulations is an anhydrous fragrance formulation.

8. The device of claim 1, wherein a bottom portion of the first fragrance formulation is coupled to a top portion of the first container and when the first hemispherical cap is in a closed position, at least a top portion of the first fragrance formulation is received by the first hemispherical cap, and wherein a bottom portion of the second fragrance formulation is coupled to a top portion of the second container and when the second hemispherical cap is in a closed position, at least a top portion of the second fragrance formulation is received by the second hemispherical cap.

9. The device of claim 1, wherein the first attacher is part of the first container and the first modular cap removably attaches to the first attacher, and the first modular cap is removed from the first module to expose the first fragrance formulation to a user of the device, and wherein the second attacher is part of the second container and the second modular cap removably attaches to the second attacher, and the second modular cap is removed from the second module to expose the second fragrance formulation to the user.

10. The device of claim 1, wherein the first and second containers each comprise one or more features extending from a top portion of the respective container, the one or more features engaging with the first and second fragrance formulations.

11. The device of claim 10, wherein the one or more features comprise one or more retainers that are least partially contained within a bottom portion of each of the first and second fragrance formulations.

12. A device, comprising:

an adaptor having an exterior annular surface and an opposing internal annular surface, the internal annular surface defining one or more first engagement features and one or more second engagement features;

a first container and a first solid fragrance contained by the first container, the first container separate from the adaptor, wherein the first solid fragrance has a dome-shaped upper surface, the first container having an outer surface defining one or more first corresponding features for engagement with the one or more first engagement features of the adaptor to removably attach the first container to the adaptor;

a first dome cap sized to at least partially receive the first solid fragrance;

a first modular cap that encloses the first dome cap and first solid fragrance, the first modular cap including threads on an interior surface for threaded engagement with threads on an exterior surface of the first container to removably attach the first modular cap to the first container;

a second container and a second solid fragrance contained by the second container, the second container separate from the adaptor, wherein the second solid fragrance has a dome-shaped upper surface, the second container having an outer surface defining one or more second corresponding features for engagement with the one or more second engagement features of the adaptor to removably attach the second container to the adaptor;

a second dome cap sized to at least partially receive the second solid fragrance; and a second modular cap that encloses the second dome cap and second solid fragrance, the second modular cap including threads on an interior surface for threaded engagement with threads on an exterior surface of the second container to removably attach the second modular cap to the second container.

13. The device of claim 12, wherein the first solid fragrance is different from the second solid fragrance.

14. The device of claim 12, wherein the first and second containers are removably attached to the adaptor, and the first and second containers are interchangeable with other containers having different solid fragrances.

15. The device of claim 12, wherein the first and second containers are permanently or semi-permanently attached to the adaptor after assembly of the device.

16. The device of claim 12, wherein the first and second containers each include one or more features extending from a top portion of the respective container for engagement with the first and second solid fragrances.

17. The device of claim 16, wherein the one or more features include retainers that at least partially extend into an interior of the first and second solid fragrances.

18. The device of claim 12, wherein each of the first and second solid fragrances comprises an anhydrous substrate and encapsulates a fragrance suspended within the anhydrous substrate.

* * * * *